United States Patent [19]

Olschansky et al.

[11] Patent Number: 4,505,475

[45] Date of Patent: Mar. 19, 1985

[54] EXERCISE SYSTEM

[76] Inventors: Brad Olschansky, 8415 Bellona La., Apt. 613, Towson, Md. 21204; Scott Olschansky, 5219 Overhill Rd., Baltimore, Md. 21207

[21] Appl. No.: 498,886

[22] Filed: May 27, 1983

[51] Int. Cl.[3] ..... A63B 21/06; A63B 23/02; A63B 23/04

[52] U.S. Cl. ..... 272/118; 272/134

[58] Field of Search ..... 272/117, 118, 132, 134, 272/93, 136, 145, 130, 131; 128/25 R, 25 B

[56] References Cited

U.S. PATENT DOCUMENTS

| | | | |
|---|---|---|---|
| 3,072,400 | 1/1963 | Dykinga | 272/118 |
| 3,912,261 | 10/1975 | Lambert, Sr. | 272/134 X |
| 4,183,520 | 1/1980 | Chase | 272/130 |
| 4,211,403 | 6/1980 | Coffaro et al. | 272/134 |
| 4,256,302 | 3/1981 | Keiser et al. | 272/118 |
| 4,422,636 | 12/1983 | de Angeli | 272/143 |

*Primary Examiner*—Robert A. Hafer
*Assistant Examiner*—Chris Coppens
*Attorney, Agent, or Firm*—Morton J. Rosenberg

[57] ABSTRACT

An exercise system (10) is provided for allowing reversible displacement of at least one weight element (12) responsive to a lifting force imparted to the weight element (12) by a user. The exercise system (10) includes an exercise frame (14) as well as an arm actuated mechanism (58) and a leg actuated mechanism (100). The arm actuated mechanism (58) is secured to the exercise frame (14) and is coupled to the weight element (12) for reversibly displacing the weight element. The leg actuated mechanism (100) is also secured to the exercise frame (14) and is also coupled to the weight element (12) to allow reversible displacement of the weight element responsive to movement of the legs of the user. An exercise coupling mechanism (128) is secured to the exercise frame (14) and the weight element (12) in order to couple the arm actuated mechanism (58) to the leg actuated mechanism (100) for providing a lifting force to the weight element (12) responsive to independent actuation of the leg mechanism (100) or the arm mechanism (58), or in the alternative, to allow for a combined actuation of the leg and arm mechanisms (100 and 58).

17 Claims, 5 Drawing Figures

EXERCISE SYSTEM

BACKGROUND OF THE INVENTION

1. Field of the Invention

This invention relates to exercising apparatus. In particular, this invention directs itself to an exercise system for exercising both the lower body and the upper body of a user. More in particular, this invention pertains to an exercise system which allows the user to independently actuate both the upper body and lower body mechanisms. Further, this invention directs itself to an exercising system which allows a combined actuation of upper body and lower body exercising mechanisms. Still further, this invention relates to an exercising system wherein either the upper body mechanism or the lower body mechanism may be engaged to assist the other mechanism in applying a lifting force to weight elements. Still further, this invention pertains to an exercising system which allows the user to use his or her upper or lower body to lift a stack of weight elements through a pulley/cable actuating mechanism. More in particular, this invention directs itself to an exercising system which includes a slack take-up mechanism within the system to maintain arm and leg cable extension members in a taut condition independent of whether the upper body mechanism, the lower body mechanism, or a combination of the upper and lower body mechanisms are actuated by the user.

2. Prior Art

Exercise systems for the upper and lower body are well-known in the art. The closest art known to the Applicants include U.S. Pat. Nos. 3,998,454; 4,349,191; 3,858,873; 4,195,834; 4,256,302; 3,112,108; and, 4,252,314.

In some prior art exercising systems, such as that shown in U.S. Pat. No. 4,252,314, there is provided an upper body exercising and lower body exercising mechanism in combination. However, in such prior art exercising systems, the upper body exercising mechanisms are coupled directly to. the lower body exercising mechanism and do not allow for independent actuation. In particular, in U.S. Pat. No. 4,252,314, a cable system is provided and directly couple the legs of the user to an arm extension bar, wherein the user applies the arm or upper body forces against the lower body forces. However, such prior art systems do not allow independent usage of the upper and lower body exercising mechanisms, and further do not allow engagement of one of the upper or lower body exercising mechanisms to assist the lifting of weight elements.

In other prior art systems, such as that shown in U.S. Pat. No. 3,112,108, the user may use hand levers to aid in moving a crankshaft operated by the user's feet. However, such prior art exercising devices do not allow for independent actuation of upper and lower body exercising mechanisms within the exercising system.

In other prior art exercising systems, upper body or arm actuated mechanisms are provided, however, such are not combined with lower body mechanisms to provide an integrated exercise system.

In still other prior art exercising systems, where upper and lower body mechanisms are provided, such systems do not allow engagement of one exercising mechanism during use of the other exercising systems to assist the user when the user has reached his or her force lifting capabilities.

SUMMARY OF THE INVENTION

An exercise system for reversibly displacing at least one predetermined weight element responsive to a lifting force imparted to said weight element by a user. The exercise system includes an exercise frame member and an arm actuated mechanism which is secured to the exercise frame and coupled to the weight element for reversibly displacing the weight element independently responsive to a displacement of at least one arm of the user. A leg actuated mechanism is secured to the exercise frame and coupled to the weight element for reversibly displacing the weight element independent of the arm actuated mechanism. Additionally, an exercise coupling mechanism is secured to the exercise frame and the weight element for coupling the arm actuated mechanism to the leg actuated mechanism for providing the lifting force to the weight element responsive to (1) a combined displacement of the arm actuated mechanism and the leg actuated mechanism, (2) an independent displacement of the arm actuated mechanism, and (3) an independent displacement of the leg actuated mechanism.

DESCRIPTION OF THE PREFERRED EMBODIMENTS

Referring now to FIGS. 1–5, there is shown exercise system 10 for reversibly displacing weight element 12 responsive to a lifting force imparted to weight element 12 by a user. In overall concept, exercise system 10 is used for the purpose of exercising a user's lower body and upper body independently or in combination. More in particular, exercise system 10 provides a mechanism whereby the user's lower body may be utilized to assist the upper body when such has reached the point of exhaustion or the limit of the upper body force lifting capabilities. Additionally, exercise system 10 allows the user to provide a means wherein the upper body may be utilized to assist the lower body when such has also either reached the point of exhaustion or the limit of the force lifting capabilities of the lower body. Still further, exercise system 10 may be utilized to provide a combination of upper body and lower body exercise conditions whereby both the upper and lower body of the user are being exercised simultaneously. Through use of exercise system 10, as will be described in following paragraphs, the user is given the capability of assisting himself or herself in an exercising program without the need of a partner due to the fact that when one portion of the body becomes exhausted, the user has the capability in one integrated exercise system 10 to aid or assist himself or herself in providing additional weight lifting capability.

Figure 1:
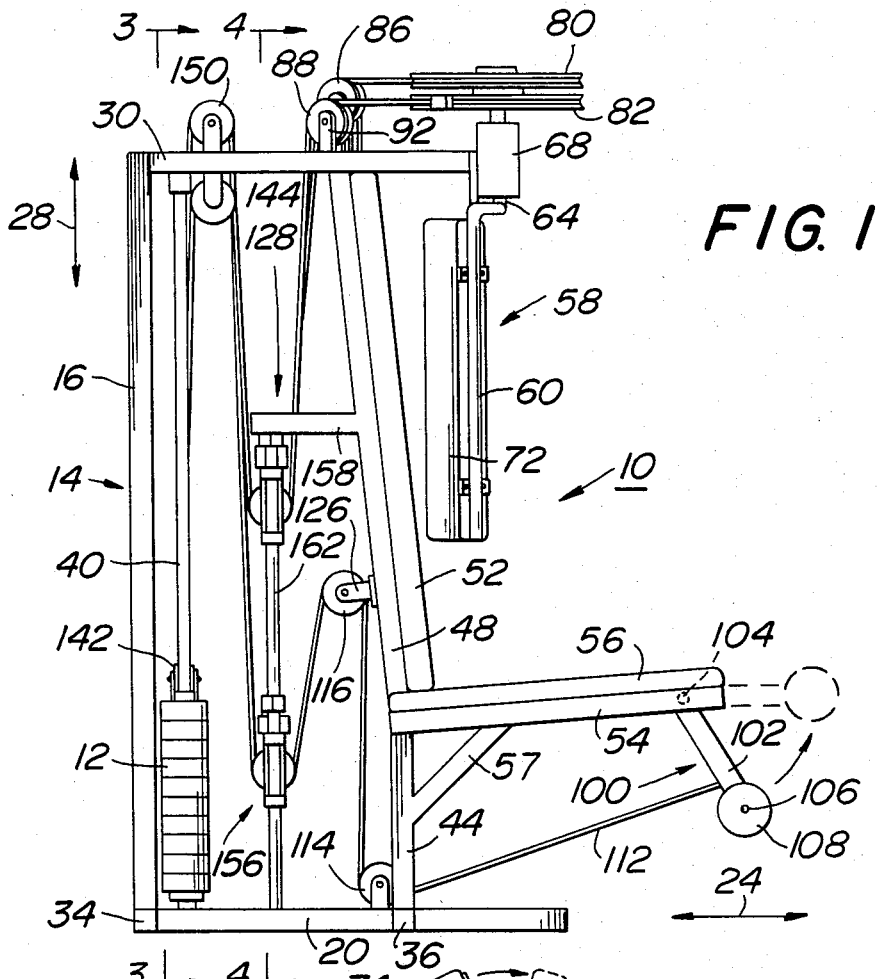
FIG. 1 is an elevational view of the exercise system.
Figure 2:
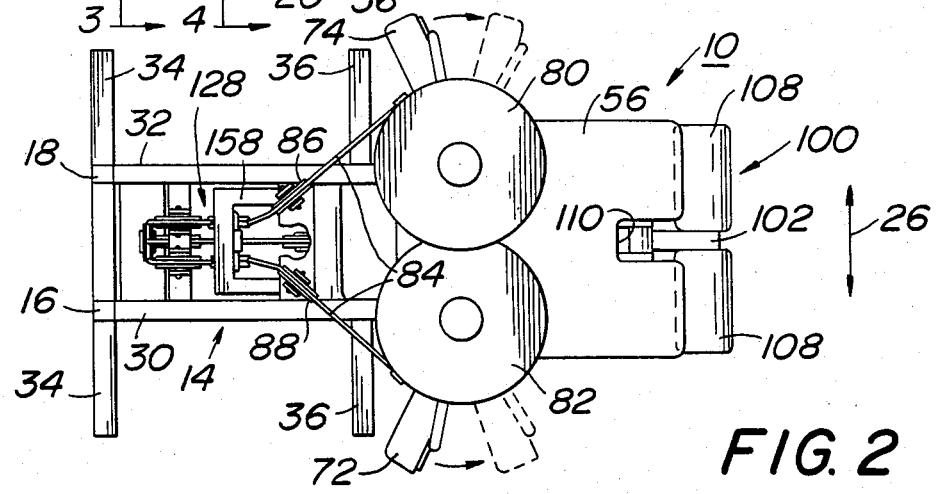
FIG. 2 is a plan view of the exercise system.

Exercise system 10 includes exercise frame member 14 for providing a housing and stabilizing set of elements to carry mechanisms to be described in following paragraphs, and further for mounting overall exercise system 10 on a base surface. Exercise frame 14 may include a pair of rear vertical column members 16 and 18 fixedly secured to a pair of forwardly extending base frame members 20 and 22. Frame base members 20 and 22 interface with a base surface to provide a stabilizing platform upon which the individual mechanisms of exercise system 10 may be mounted. Frame base members 20 and 22 may be fixedly secured to rear vertical column members 16 and 18 through bolts, welding, or some like technique not important to the inventive concept as herein described. Frame base members 20 and 22 extend in longitudinal direction 24 and are displaced each from the other in transverse direction 26, as is shown in FIGS. 1 and 2. Rear vertical column members 16 and 18 extend in vertical direction 28 and are fixedly secured to upper frame base members 30 and 32.

Upper and lower frame base members 30 and 32 extend in longitudinal direction 24 and are secured to vertically directed column members 16 and 18 in a fixed securement manner through bolting or welding, as has previously been described. Rear and forward cross frame members 34 and 36 extending in transverse direction 26 interface with the base surface upon which exercise system 10 is mounted, and provide for additional stability for exercise system 10. All of the column and frame members making up exercise frame 14 may be formed of a steel composition, or some like material sufficient to provide structural integrity for the exercises performed on exercise system 10.

Figure 3:
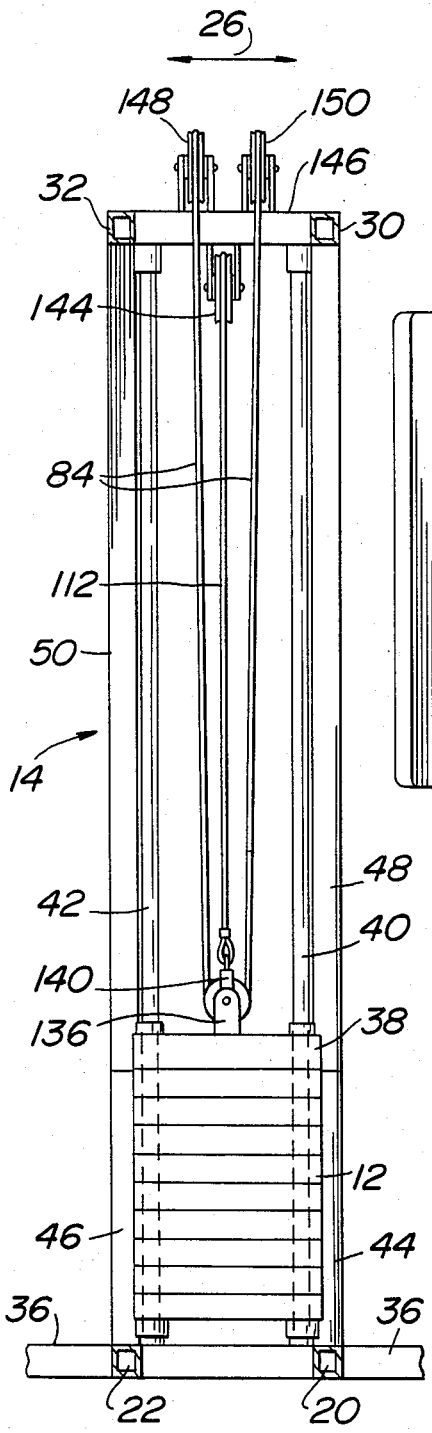
FIG. 3 is a sectional view of the exercise system taken along the Section Line 3—3 of FIG. 1.

The object of exercise system 10 is to allow the user to repetitively and reversibly apply a force to weight elements 12 for lifting such in vertical direction 28. To this end, and as is well-known in the prior art, weight element 12 may include a plurality of removable weights 12 as is clearly shown in FIGS. 1 and 3. Weight elements 12 include upper reference weight 38 which is coupled to other mechanisms in exercise system 10, as will be described in following paragraphs. Weight elements 12 are slidingly displaceable on vertically extending weight rods 40 and 42, as is seen in FIGS. 1 and 3. One or more weight elements 12 may be stacked in interfacing relationship, each with respect to the other, to provide a variable amount of gravity assist reaction forces against which the user is applying a lifting force. Weight elements 12 may be standard weight elements well-known in the art, and may be formed of steel, lead, or some like composition, not important to the inventive concept with the exception that weight elements 12 be of a known weight.

Figure 4:
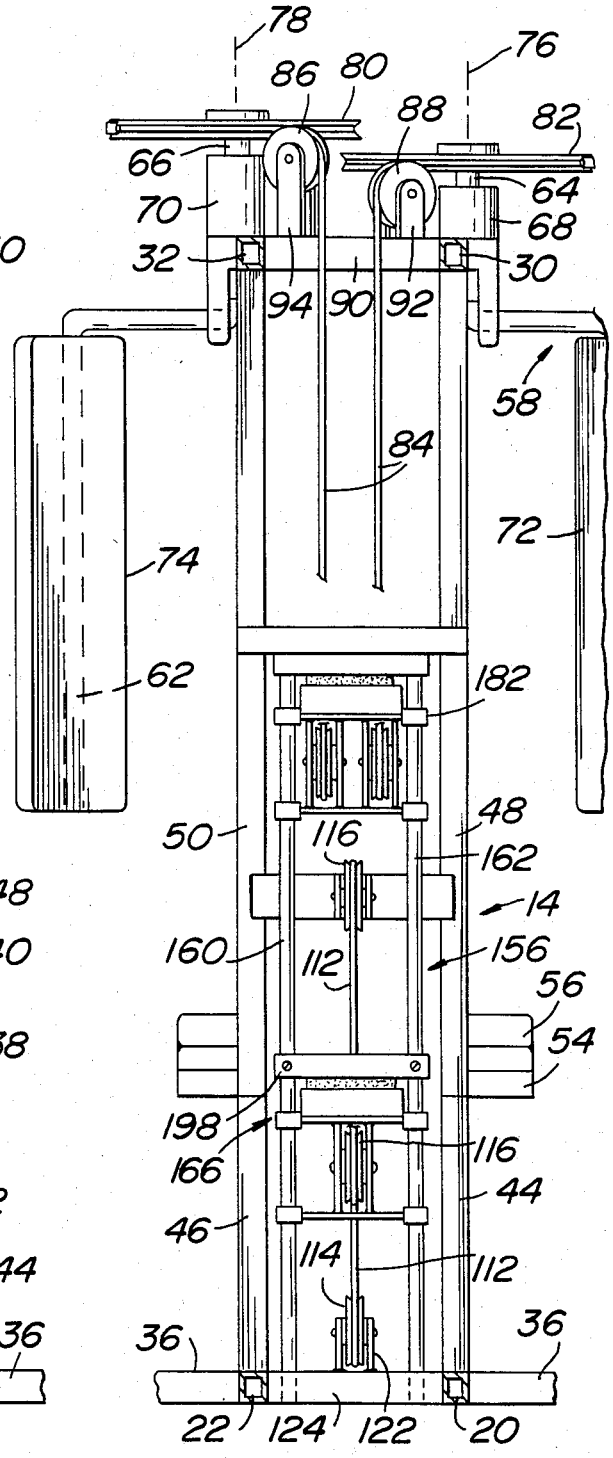
FIG. 4 is a sectional view partially cut-away of the exercise system taken along the Section Line 4—4 of FIG. 1; and, FIG. 5 is a schematic perspective view of the pulley and cable system associated with the exercise system.

Exercise frame 14 further includes forward vertical columns 44 and 46, shown in FIGS. 1, 3 and 4, which are fixedly coupled to forward cross frame member 36. Additionally, upwardly extending forward inclined columns 48 and 50 are provided for backrest member 52 in order that the user may press thereagainst during operation of exercise system 10. Backrest member 52 may be formed of a standard type cushioning material commonly used for chairs, and not important to the inventive concept as herein described. Seat bar member 54 extends in an inclined manner and substantially in longitudinal direction 24 to provide a base upon which seat element 56 rests. Strut member 57 may be provided between seat bar member 54 and forward vertical columns 44 and 46 to provide additional strength. In this manner, the user is able to sit on seat element 56 and rest his or her back on backrest member 52 during the exercising procedure.

Referring now to the upper body or arm actuated mechanism 58 shown in FIGS. 1–4, it is seen that mechanism 58 is secured to exercise frame 14 and ultimately coupled to weight elements 12 for reversibly displacing weight elements 12 independently responsive to a displacement of at least one arm of the user. In particular, arm actuated mechanism 58 includes arm bar members 60 and 62 which are rotatable about a substantially vertically directed axis. Arm bar members 60 and 62, as is clearly seen in FIG. 4, are substantially L-shaped in contour and are fixedly secured to arm rods 64 and 66 through respective bearing members 68 and 70, which are fixedly mounted to an upper portion of exercise frame 14 through welding, bolting, or some like technique, not important to the inventive concept. Attached to arm rods 60 and 62 are associated arm pad members 72 and 74 to provide a resilient composition upon which the user may comfortably rotate arm bar members 60 and 62 about respective vertical axes 76 and 78, as is shown in FIG. 4. In this manner, rotation of arm bar members 60 and 62 within bearing members 68 and 70 provide for a rotative displacement of associated arm rods 64 and 66 about axes 76 and 78.

Figure 5:
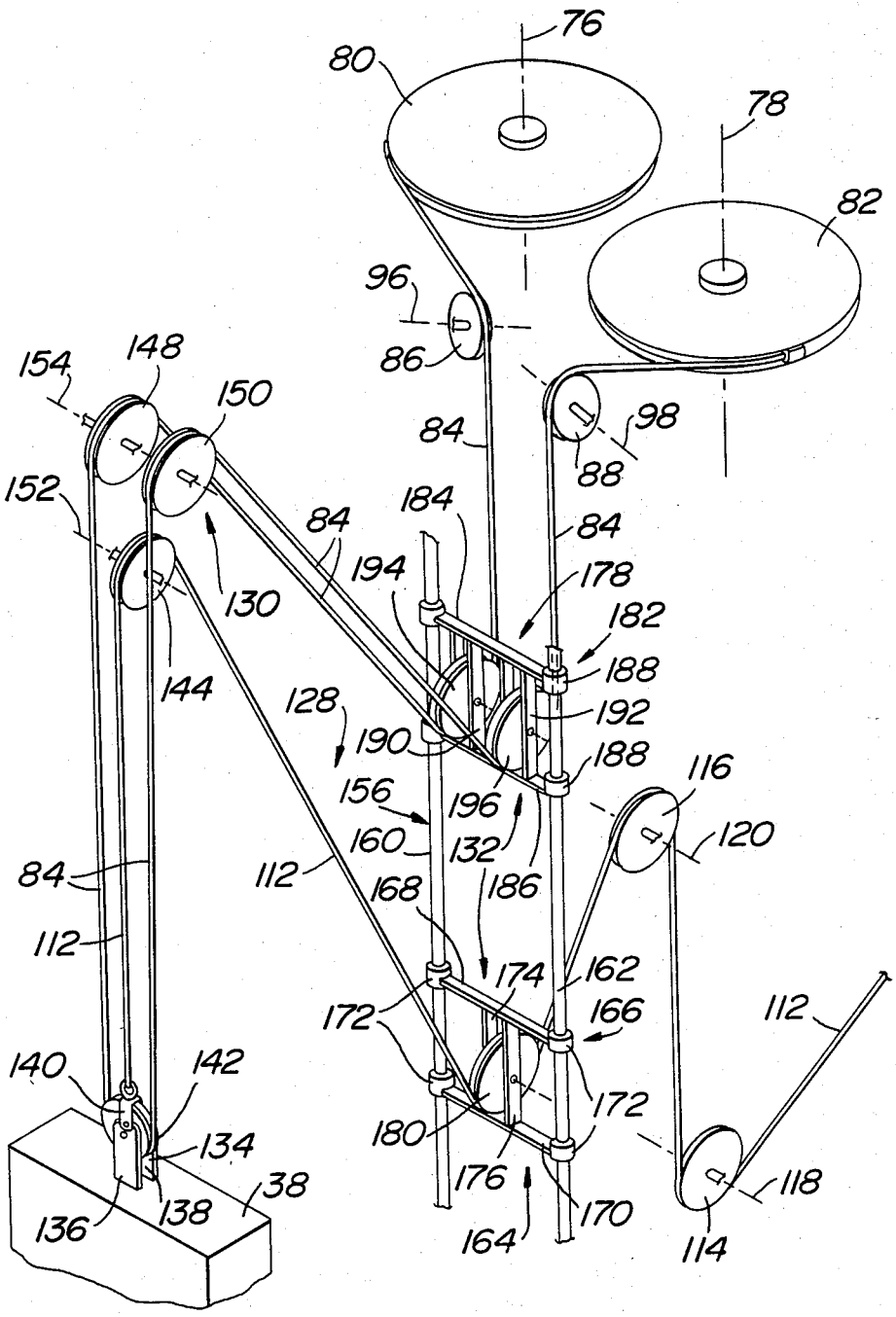

Arm actuated mechanism 58 further includes a pair of arm pulley members 80 and 82 fixedly secured to arm rods 64 and 66, respectively. Arm pulley members 80 and 82 are thus rotatable in a generally horizontal plane responsive to a rotation of arm bar members 60 and 62 by the user. As is seen, arm pulley members 80 and 82 are displaced each from the other in vertical direction 28, since they are overlapping as is shown in FIGS. 2 and 4. Arm cable member 84, as is clearly seen in the pulley diagram of FIG. 5, is fixedly secured on opposing ends thereof to each of arm pulley members 80 and 82. As will be further described in following paragraphs, arm cable member 84 is coupled to weight elements 12 for vertical displacement of such weight elements 12. Arm cable member 84 is fixedly secured to the periphery of arm pulley members 80 and 82 by welding, bolting, or one of many known types of clamping devices which will allow fixed securement between the ends of arm cable member 84, and pulleys 80 and 82 to allow displacement of arm cable member 84 responsive to respective rotations of arm pulley members 80 and 82.

A pair of inclined pulley members 86 and 88 are rotatably actuated about an axis substantially normal to vertical direction 28, however, such axes are inclined with respect to longitudinal direction 24. Arm cable member 84 is in contiguous contact with each of inclined pulley members 86 and 88 for redirecting a horizontal displacement of arm cable member 84 to a substantially vertical displacement, responsive to the rotation of arm pulley members 80 and 82. Inclined pulley members 86 and 88 are rotatively secured to upper bar member 90 of exercise frame 14 through vertically extending pulley lug elements 92 and 94, as is shown in FIG. 4. Lug members 92 and 94 are fixedly secured to exercise frame 14 and inclined pulley members 86 and 88 are rotatively displaceable with respect to lug members 92 and 94 about inclined axes 96 and 98, as is shown in FIG. 5.

Exercise system 10 further includes leg actuated mechanism 100 which is secured to exercise frame member 14 and ultimately coupled to weight element 12 for reversibly displacing weight element 12 independent of arm actuated mechanism 58. Leg actuated mechanism 100 is actuatable through a force applied by the legs of the user.

Leg actuated mechanism 100 includes leg bar member 102 which is rotatable about a substantially horizontal axis, and pivotally connected to seat bar member 54 at pivot point 104. Leg bar member 102 is fixedly coupled to a transversely directed leg rod member 106 which may have leg padding 108 encompassing leg rod member 106 to provide a resilient or elastic composition for the comfort of the user when rod 106 is being arcuately displaced as shown by the directional arrow of FIG. 1.

In order to allow rotative displacement of leg bar member 102, seat member 56 may include seat recess 110 having a width in transverse direction 26 sufficient to accomodate and allow passage of leg bar member 102 therethrough. In this manner, leg bar member 102 and associated leg rod 106 and leg padding 108 may be arcuately moved or displaced through a large angular range, as is shown in FIG. 1 between the solid line drawing and the phantom line displacement.

Leg cable member 112 is fixedly secured on one end thereof to leg bar member 102 and ultimately on a second end secured to weight elements 12. Securement of leg cable member 112 to leg bar member 102 may be through tying, bolting, welding, or some like method, not important to the inventive concept as herein described, with the exception that leg cable member 112 must be displaced as a function of the rotative displacement of leg bar member 102.

Leg actuated mechanism 100 further includes first leg pulley member 114 which is rotatively coupled to exercise frame 14 and second leg pulley member 116 which is vertically displaced from first leg pulley member 114. Both first and second leg pulley members 114 and 116 are rotatably displaceable about respective axes 118 and 120, as shown in FIG. 5. Leg cable member 112 passes from leg bar member 102 into contiguous contact with first leg pulley member 114 and then into contiguous contact with second leg pulley member 116 for redirecting the displacement direction of leg cable member 112 from a generally inclined path, as shown in FIG. 1 to a generally vertically directed displacement path. First leg pulley member 114 is coupled through lug members 122 to lower bar member 124, as is shown in FIG. 4. First leg pulley member 114 is rotatable with respect to lug member 122 about axis 118, as has been previously described. Second leg pulley member 116 in a similar manner is coupled by lug members 126 to inclined column section 48, as is shown in FIG. 1.

Exercise system 10 further includes exercise coupling mechanism 128 secured to exercise frame 14 and weight elements 12 for coupling arm actuated mechanism 58 to leg actuated mechanism 100 for providing a lifting force to weight elements 12 responsive to (1) a combined displacement of arm actuated mechanism 58, and leg actuated mechanism 100, (2) an independent displacement of arm actuated mechanism 58 and, (3) an independent displacement of leg actuated mechanism 100.

Exercise coupling mechanism 128 includes coupling mechanism 130 for coupling arm cable member 84 and leg cable member 112 to weight elements 12. Additionally, cable slack mechanism 132 is provided fcr maintaining arm cable member 84 and leg cable member 112 in a substantially taut condition, responsive to a displacement of weight elements 12.

Coupling mechanism 130 for coupling arm cable member 84 and leg cable member 112 to weight element stack 12 and in particular, to upper weight element 38, includes coupling frame 134 which is fixedly secured to upper weight element 38 by coupling bars 136 and 138, shown in FIG. 5. Coupling bars 136 and 138 may be secured by welding or some like technique to upper weight element 38. Coupling frame 134 includes bridge element 140 which is generally an inverted U-shape and is secured to leg cable member 112, as is shown. The inverted arms of bridge element 140 are coupled on opposing ends to coupling bars 136 and 138 through a fixed securement, such as bolts or some like technique.

Mounted between coupling bars 136 and 138 is coupling pulley member 142 which is rotationally secured to coupling frame 134 for contiguously interfacing with arm cable member 84 and being rotationally activated responsive to a displacement of arm cable member 84.

Leg cable member 112 passes from bridge element 140 into contact with leg coupling pulley 144 which is rotationally secured to exercise frame 14. Leg coupling pulley as shown in FIG. 3, is mounted to an underside of frame bar member 146, and is rotationally actuatable with respect thereto. Leg cable member 112 contiguously interfaces with leg coupling pulley member 144 for rotatively actuating leg coupling pulley member 144, responsive to a displacement of leg cable member 112. Leg cable member 112 then passes in an inclined downward manner to cable slack mechanism 132, which will be more fully described in following paragraphs.

Arm cable member 84 contiguously interfaces with coupling pulley member 142 and passes in an upward substantially vertical manner to arm coupling pulleys 148 and 150. Arm coupling pulleys 148 and 150 are transversely displaced each from the other, and mounted in a fixed manner to frame bar 146, as is shown in FIG. 3. Arm coupling pulleys 148 and 150, as well as leg coupling pulley 144, are secured to frame bar member 146 by extension members previously described and in themselves, coupled through welding, bolting, or some like technique, to frame 12 of exercise system 10. In this manner, arm coupling pulleys 148 and 150, as well as leg coupling pulley 144 are rotationally actuatable about transverse axes 152 and 154, as shown in FIG. 5. Thus, arm cable member 84 contiguously interfaces with arm coupling pulley members 148 and 150 for rotatively actuating arm coupling pulley members 148 and 150, responsive to a displacement of arm cable member 84. Subsequent to passage over arm coupling pulley members 148 and 150, arm cable member 84 passes in a downward inclined manner, as shown in FIG. 5, and FIG. 1, to cable slack mechanism 132 to be described in following paragraphs.

Cable slack mechanism 132 shown in FIGS. 1, 4 and 5, includes cable slack frame 156, which is fixedly secured to exercise frame 14 between lower bar member 124 and upper bar member 158, which is coupled to inclined forward column members 48 and 50. Cable slack frame 156 includes slack rod members 160 and 162, which extend in a substantially vertical direction.

Leg slack mechanism 164 is displaceably coupled to cable slack frame 156 and is reversibly vertically displaceable with respect to cable slack frame 156, responsive to a displacement of leg cable member 112. Leg slack mechanism 164 includes leg slack frame 166 which is slidingly coupled to slack rod members 160 and 162. Leg slack frame 166 includes upper and lower leg bar members 168 and 170, which are slidingly coupled to rods 160 and 162 by bearing elements 172. Upper and lower leg slack bar members 168 and 170 are fixedly coupled each to the other by extension members 174 and 176 fixedly fastened through welding, bolting or some like technique to respective upper and lower leg slack bar members 168 and 170. Opposing extension mcmbers 174 and 176 sandwich therebetween leg slack pulley 180 which is rotatively coupled with respect to extension members 174 and 176. Leg pulley member 180 contiguously interfaces with leg cable member 112, as is clearly seen. Additionally, leg slack frame 166 as a unit, may be vertically displaced in a reversible manner with respect to cable slack rod members 160 and 162, responsive to a displacement of leg cable member 112.

In a similar manner, arm slack mechanism 178 is displaceably coupled to cable slack frame 156 for being reversibly and vertically displaced with respect to cable slack frame 156, responsive to a displacement of arm cable member 84. Arm slack mechanism 178 includes arm slack frame 182 which is slidingly coupled to slack rod members 160 and 162. Arm slack frame 182 includes upper and lower arm bar members 184 and 186 which are secured to bearings 188 adapted to be slidingly engaged with rods 160 and 162.

As in the case of leg slack mechanism 164, arm slack frame 182 includes vertically extending extension members 190 and 192, which are fixedly secured on opposing ends thereof to upper arm bar member 184 and lower arm bar member 186. Each pair of extension members 190 and 192 have rotatably coupled therebetween arm slack pulley members 194 and 196, respectively. Arm slack pulley members 194 and 196 are thus secured to arm slack frame 182 and rotatively actuatable with respect thereto. Pulley members 194 and 196 may be coupled to the pairs of extension members 192 and 194 through pivot pins, or some like mechanism, not important to the inventive concept, with the exception that pulley members 194 and 196 be rotatable with respect to arm slack frame 182. Each of arm slack pulley members 194 and 196 contiguously interface with arm cable member 84 and allow for reversible displacement of arm slack frame 182, responsive to a displacement of arm cable member 84.

In this manner, arm slack frame 182 and leg slack frame 166 may be vertically displaced responsive to displacement of arm cable member 84 and leg cable member 112. Additionally, it is to be noted that through gravity assist, arm slack frame 182 and leg slack frame 162 are biased in a downward vertical direction, and tend to move in a downward manner when slidingly engaging rod members 160 and 162.

Stop member 198, as is shown in FIG. 4, is fixidly coupled to opposing rods 160 and 162 to limit the travel of arm slack frame 182 and leg slack frame 166. Stop member 198 may merely be a bar element passing in transverse direction 26 for limiting the upward travel or displacement of leg slack frame 166 and the downward travel of arm slack frame 182.

In operation, assuming that a user is using arm actuated mechanism 58 independent of leg actuated mechanism 100, the user rotatively actuates arm rods 64 and 66. Rotative displacement of arm rods 64 and 66 causes a rotative displacement of arm pulley members 80 and 82, which displace arm cable 84 since such is fixedly secured to the periphery of pulleys 80 and 82. Arm cable member 84 passes in contiguous interfacing relation with arm slack pulley members 194 and 196 mounted on arm slack mechanism 178. Arm cable 84 passes over arm coupling pulleys 148 and 150 and pass around coupling pulley member 142 to cause a displacement of weight stack elements 12. Rotation of pulley members 80 and 82 in a counter-clockwise direction as shown in FIG. 5, causes a movement of arm slack mechanism 178 in an upward direction on rod members 160 and 162. As weight stack elements 12 are moved in an upward direction, leg slack frame 166 moves downwardly by gravity assist and maintains leg cable 112 in a taut condition through interface with leg pulley member 180.

Rotative movement of arm pulley members 80 and 82 in a clockwise manner as shown in FIG. 5, cause arm slack mechanism 178 to move in a downward direction while lowering weight stack elements 12. As stack elements 12 move downwardly, an upward force is applied to leg pulley member 180 by cable member 112 which remains in a taut condition and subsequently, moves leg slack frame 166 in an upward direction until it reaches stop member 198 which limits the travel of leg slack frame 166. Thus, during clockwise and/or counter-clockwise rotation of arm pulley members 80 and 82, cable members 112 and 84 are maintained in a taut state.

Assuming now that the user has partially lifted weight stack elements 12 and has reached the point of exhaustion and can no longer cause a rotation of arm pulley members 80 and 82, he or she may assist themselves by rotating leg rod 106 as shown in FIG. 1. Rotation of leg rod 106 in an upward manner causes leg cable member 112 to bear against leg pulley member 180 and ultimately on bridge element 140 coupled to weight stack elements 12. Leg slack frame 166 is moved upwardly until it contacts stop member 198 and then begins to take up the load or lifting force applied to weight stack elements 12. Continued rotative displacement of leg rod 106 will thus transfer some of the lifting force from the arms of the user to the legs of the user and allow the user to assist himself or herself in raising weight elements 12.

It is obvious to one skilled in the art that the process is reversible, and that a user may assist himself or herself by using arm actuated mechanism 58 subsequent to exhaustion during actuation of leg actuated mechanism 100.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An exercise system for reversibly displacing at least one predetermined weight element responsive to a lifting force imparted to said weight element by a user, comprising:

(a) an exercise frame member;

(b) arm actuated means secured to said exercise frame member and coupled to said weight element for reversibly displacing said weight element responsive to a displacement of at least one arm of said user, said arm actuated means including a pair of arm bar members rotatable about a substantially vertical axis, a pair of arm pulley members fixedly secured to said arm bar members and rotatable therewith, and an arm cable member fixedly secured on opposing ends thereof to each of said arm pulley members;

(c) leg actuated means secured to said exercise frame member and coupled to said weight element for reversibly displacing said weight element independently of a displacement of said arm actuated means, said arm actuated means being displaceable independent of a displacement of said leg actuated means; and, (d) exercise means secured to said exercise frame member and said weight element for coupling said arm actuated means to said leg actuated means for providing said lifting force to said weight element responsive to (1) a combined displacement of said arm actuated means and said leg actuated means, (2) an independent displacement of said arm actuated means, and, (3) an independent displacement of said leg actuated means, said arm cable member being coupled to said exercise coupling means for displacement of said weight element.

2. The exercise system as recited in claim 1 including a pair of inclined pulley members rotatably actuated about an axis substantially normal said vertical direction, said arm cable member in contiguous contact with each of said inclined pulley members for redirecting a horizontal displacement of said arm cable member to a vertical displacement of said arm cable member.

3. The exercise system as recited in claim 1 where said leg actuated means includes:

(a) at least one leg bar member rotatable about a substantially horizontal axis;

(b) a leg cable member having a first end fixedly secured to said leg bar member and a second end secured to said exercise coupling means.

4. The exercise system as recited in claim 3 including leg pulley means rotatably coupled to said exercise frame member for redirecting a displacement direction of said leg cable member responsive to a rotative displacement of said leg bar member.

5. The exercise system as recited in claim 4 where said leg pulley means includes:

(a) a first leg pulley member rotatively coupled to said exercise frame member; and, (b) a second leg pulley member displaced from said first leg pulley member, said first and second leg pulley members being rotatable about a substantially horizontal axis.

6. The exercise system as recited in claims 2 or 3 where said exercising coupling means includes:

(a) means for coupling said arm cable member and said leg cable member to said weight element; and, (b) cable slack means for maintaining said arm cable member and said leg cable member in a substantially taut condition responsive to a displacement of said weight element.

7. The exercise system as recited in claim 6 where said means for coupling said arm cable member and said leg cable member to said weight element includes:

(a) a coupling frame fixedly secured to said weight element, said leg cable member being secured to said coupling frame; and, (b) rotative coupling means rotationally secured to said coupling frame for contiguously interfacing with said arm cable member and being rotationally activated responsive to a displacement of said arm cable member.

8. The exercise system as recited in claim 7 where said rotative coupling means includes a coupling pulley member rotationally secured to said coupling frame.

9. The exercise system as recited in claim 7 including a leg coupling pulley member rotationally secured to said exercise frame member, said leg cable member contiguously interfacing with said leg coupling pulley member for rotatively actuating said leg coupling pulley member responsive to a displacement of said leg cable member.

10. The exercise system as recited in claim 7 including a pair of arm coupling pulley members rotationally secured to said exercise frame member, said arm cable member contiguously interfacing with said arm coupling pulley member for rotatively actuating said arm coupling pulley members responsive to a displacement of said arm cable member.

11. The exercise system as recited in claim 6 where said cable slack means includes:

(a) a cable slack frame fixedly secured to said exercise frame member;

(b) leg slack means displaceably coupled to said cable slack frame for being reversibly vertically displaced with respect to said cable slack frame responsive to a displacement of said leg cable member; and, (c) arm slack means being displaceably coupled to said cable slack frame for being reversibly vertically displaced with respect to said cable slack frame responsive to a displacement of said arm cable member.

12. The exercise system as recited in claim 11 where said cable slack frame includes a pair of slack rod members extending in a substantially vertical direction, said slack rod members being fixedly secured to a base member of said exercise frame.

13. The exercise system as recited in claim 12 where said leg slack means includes:

(a) a leg slack frame slidingly coupled to said pair of slack rod members; and, (b) leg slack pulley means secured to said leg slack frame and rotatively actuatable with respect thereto, said leg slack pulley means contiguously interfacing with said leg cable member, said leg slack pulley means for vertically displacing said leg slack frame responsive to a displacement of said leg cable member.

14. The exercise system as recited in claim 13 where said leg slack pulley means includes:

(a) at least one leg slack bar member fixedly fastened to said leg slack frame; and, (b) a leg slack pulley member rotatively coupled to said leg slack bar member, said leg slack pulley member being interfaced with said leg cable member.

15. The exercise system as recited in claim 12 where said arm slack means includes:

(a) an arm slack frame slidingly coupled to said pair of slack rod members; and, (b) arm slack pulley means secured to said arm slack frame and rotatively actuatable with respect thereto, said arm slack pulley means contiguously interfacing with said arm cable member, said arm slack pulley means for vertically displacing said arm slack frame responsive to a displacement of said arm cable member.

16. The exercise system as recited in claim 15 where said arm slack pulley means includes:

(a) at least a pair of arm slack bar members fixedly secured to said arm slack frame; and, (b) a pair of arm slack pulley members, each of said arm slack pulley members rotatively coupled to a respective one of said arm slack bar members, said arm slack pulley members being interfaced with said arm cable member.

17. The exercise system as recited in claim 12 including a stop member fixedly secured to said pair of slack rod members for providing a limiting displacement for said leg slack means and said arm slack means.

* * * * *